US005882134A

United States Patent [19]

Hatch

[11] Patent Number: 5,882,134

[45] Date of Patent: Mar. 16, 1999

[54] DISPENSING TOOTHBRUSH

[76] Inventor: Nigelle V. Hatch, 19604 Shrewsbury, Detroit, Mich. 48221

[21] Appl. No.: 727,902

[22] Filed: Oct. 9, 1996

[51] Int. Cl.[6] ..... A46B 11/02

[52] U.S. Cl. ..... 401/281; 401/123; 401/175; 401/191

[58] Field of Search ..... 401/191, 281, 401/123, 124, 125, 175, 153

[56] References Cited

U.S. PATENT DOCUMENTS

| | | | |
|---|---|---|---|
| 973,865 | 10/1910 | Hitz | 401/281 |
| 1,003,159 | 9/1911 | Stewart | 401/123 |
| 2,439,166 | 4/1948 | Hoffman et al. | 401/191 X |
| 2,766,472 | 10/1956 | Durrett | 401/281 |
| 2,845,646 | 8/1958 | Robinson | 401/281 |
| 3,391,980 | 7/1968 | Duncan | 401/153 |
| 4,467,822 | 8/1984 | Blackwell | 401/191 X |
| 4,963,046 | 10/1990 | Eguchi | 401/160 |
| 5,087,143 | 2/1992 | Hertampf | 401/146 |
| 5,096,321 | 3/1992 | Mountain | 401/149 |
| 5,407,287 | 4/1995 | Braun et al. | 401/176 |

FOREIGN PATENT DOCUMENTS

| | | | |
|---|---|---|---|
| 2623062 | 5/1989 | France | 401/191 |
| 266598 | 4/1950 | Switzerland | 401/281 |

*Primary Examiner*—Steven A. Bratlie
*Attorney, Agent, or Firm*—Joseph N. Breaux

[57] ABSTRACT

A dispensing toothbrush for use when cleaning teeth comprises a toothbrush base plate, a plurality of bristles implanted in and projected perpendicularly upward from the toothbrush base plate, toothbrush neck member, a sleeve concentric about toothbrush neck member, a thumb lever coupled to the sleeve for rotating the sleeve when pressure is applied to the thumb lever, and toothpaste wiping trough, coupled to the sleeve, for receiving toothpaste therein from the toothbrush neck member. In operation, as pressure is applied to the thumb lever, the sleeve rotates and the toothpaste wiping trough rotates around the toothbrush base plate and the plurality of bristles for evenly distributing the toothpaste onto the top surface area of the plurality of bristles, in a single wiping action. The dispensing toothbrush further comprises a toothpaste reservoir and a dispensing mechanism coupled theretogether for storing toothpaste and dispensing the toothpaste into the toothpaste wiping trough via the toothbrush neck member.

3 Claims, 2 Drawing Sheets

DISPENSING TOOTHBRUSH

TECHNICAL FIELD

The present invention relates to a toothbrush and, more particularly to a dispensing toothbrush having toothpaste stored therein whereby a sufficient amount of toothpaste or the like is easily dispensed and evenly distributed along the top surface area of a plurality of bristles to obtain a good cleaning effect when the user brushes his or her teeth.

BACKGROUND OF THE INVENTION

Typically, a toothbrush has a plurality of bristles wherein a sufficient amount of toothpaste is evenly distributed along the top surface area of the plurality of bristles to obtain good cleaning effect, when the user brushes his or her teeth. Conventionally, toothpaste is dispensed via squeezable tubes. As the toothpaste is evenly distributed along the top surface area of the plurality of bristles, the toothpaste substantially remains in place because of its non-fluid property until the user brushes his or her teeth.

Toothbrushes have been designed to store toothpaste therein and dispense the toothpaste into the plurality of bristles. Because the prior toothpaste dispensing toothbrushes dispense toothpaste into the bottom surface area of the plurality of bristles, the toothpaste is not evenly distributed along the top surface area of the bristles reducing the cleaning effect of the toothpaste. Moreover, since the toothpaste is dispensed from an aperture in the toothbrush base plate and dispersed therefrom into the bottom surface area of the plurality of bristles, the toothpaste does not reach the teeth when brushing.

The known dispensing toothbrushes do not address the need for a dispensing toothbrush having toothpaste or the like stored therein whereby a sufficient amount of toothpaste or the like is easily dispensed and evenly distributed along the top surface area of a plurality of bristles to obtain a good cleaning effect when the user brushes his or her teeth.

SUMMERY OF THE INVENTION

The preferred embodiment of the dispensing toothbrush of the present invention solves the aforementioned problems in a straight forward and simple manner. What is provided is a dispensing toothbrush having toothpaste stored therein whereby a sufficient amount of toothpaste is easily dispensed and evenly distributed along the top surface area of a plurality of bristles to obtain a good cleaning effect when the user brushes his or her teeth.

In particular, the dispensing toothbrush includes a toothbrush base plate; a plurality of bristles implanted in and projected perpendicularly upward from the toothbrush base plate; a toothbrush neck member; a sleeve concentric about the toothbrush neck member; a thumb lever coupled to the sleeve for rotating the sleeve when pressure is applied to the thumb lever; and a toothpaste wiping trough, coupled to the sleeve, for receiving toothpaste therein from the toothbrush neck member. In a preferred embodiment, the dispensing toothbrush further includes a toothpaste reservoir and a dispensing means for storing the toothpaste and dispensing the toothpaste into the toothpaste wiping trough via the toothbrush neck member.

In view of the above, an object of the invention is to provide a dispensing toothbrush having a toothpaste wiping trough and thumb lever for evenly distributing toothpaste, in a single wiping action onto the top surface area of the plurality of bristles.

A further object of the invention is to provide a dispensing toothbrush having a toothpaste reservoir and dispensing means for storing toothpaste therein which is easily cleaned and refilled after the toothpaste is used up thereby extending the useful life of the dispensing toothbrush of the present invention.

Another object of the invention to provide a dispensing toothbrush having a toothpaste reservoir and dispensing means that substantially empties the toothpaste therefrom, thereby significantly reducing the amount of toothpaste or the like wasted.

It is a still further object of the invention to provide a dispensing toothbrush that is simple and inexpensive in construction.

The above objects and other features of the present invention will become apparent from the drawing, the description given herein, and the appended claims.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
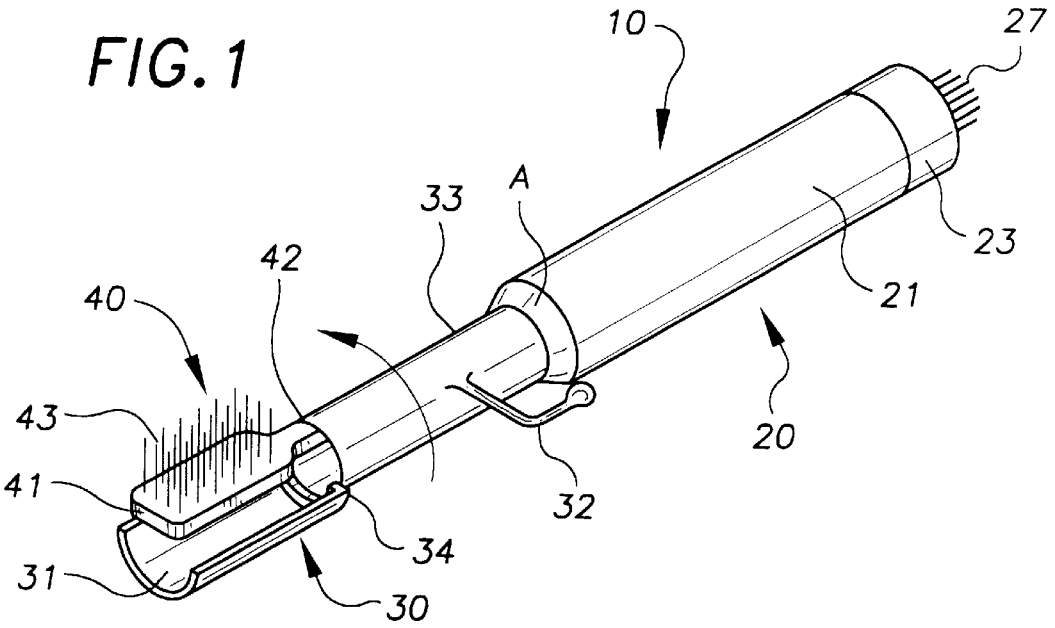
FIG. 1 illustrates a perspective view of the dispensing toothbrush of the exemplary embodiment of the present invention.

Referring now to the drawings, and in particular FIG. 1, the dispensing toothbrush of the present invention is designated generally by the numeral 10. Dispensing toothbrush 10 includes a toothpaste reservoir and dispensing means 20, a wiping means 30 and a brushing means 40.

Brushing means 40 comprises a toothbrush base plate 41, a toothbrush neck member 42 (FIG. 2) and a plurality of bristles 43, each unitarily formed theretogether. Toothbrush base plate 41 is a substantially flat rectangular plate having the plurality of bristles 43 implanted therein and projected perpendicularly upward therefrom, such that the plurality of bristles 43 are equally spaced in a plurality of rows. One end of toothbrush base plate 41 tapers to toothbrush neck member 42 (FIG. 2).

The plurality of bristles 43 are made of plastics, such as nylon. Additionally, the height of each of the plurality of bristles 43 may be substantially equal or the height of the bristles in alternating rows of said plurality of rows may be slightly higher. The plurality of bristles 43 have a sufficient density to obtain a good massaging and cleaning effect.

Figure 2:
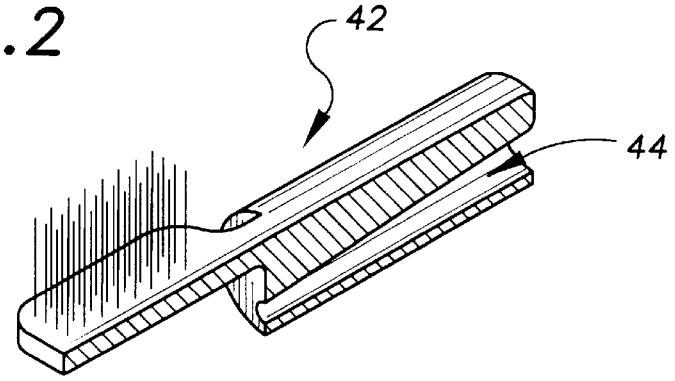
FIG. 2 illustrates a cross-section view of the toothbrush neck member of the embodiment of FIG. 1.

The tapered portion of toothbrush base plate 41 is coupled to the upper portion of toothbrush neck member 42 (FIG. 2).

As illustrated in FIG. 2, a cross-section view of toothbrush neck member 42, toothbrush neck member 42 is a cylindrically shaped member. The interior of toothbrush neck member 42 has formed therein an angled conduit 44 whereby the toothpaste, when dispensed, passes therethrough. The top surface of conduit 44 slopes downward thereby decreasing the circumference of conduit 44, accordingly.

Figure 3:
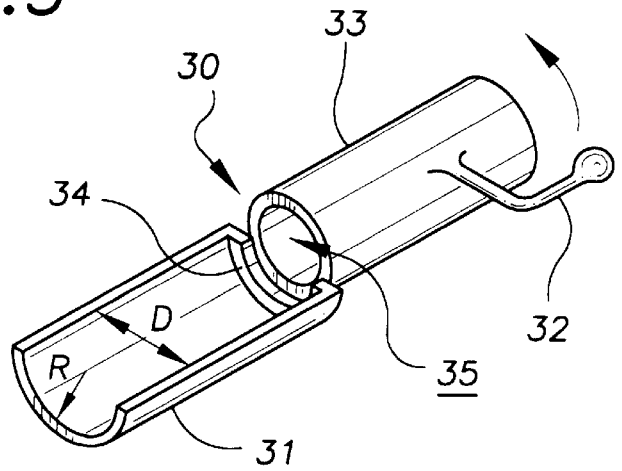
FIG. 3 illustrates an exploded view of the thumb lever and toothpaste wiping trough of the embodiment of FIG. 1.
Figure 6:
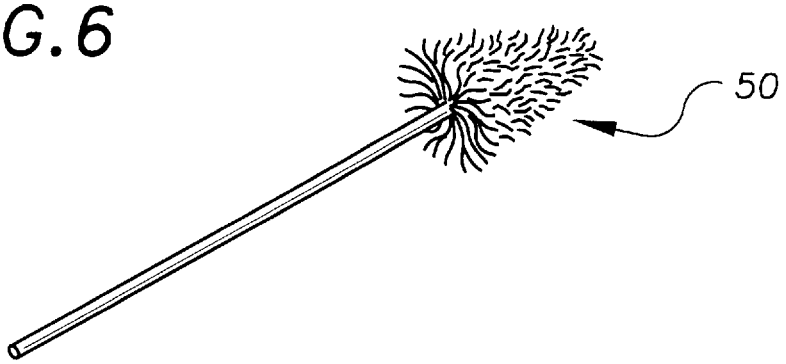
FIG. 6 illustrates an example of the cleaning brush for use with the embodiment of FIG. 1.

As depicted in FIG. 3, a detailed view of wiping means 30 is illustrated. Wiping means 30 comprises a toothpaste wiping trough 31, a thumb lever 32 and a sleeve 33, each unitarily formed theretogether. Toothpaste wiping trough 31 is semi-cylindrically shaped and has a radius R. Radius R is at least equal to the length of toothbrush base plate 41 (FIG. 1) plus the longest length of the plurality of bristles 43 (FIG. 1) implanted therein. One distal end of toothpaste wiping trough 31 is opened thereby permitting toothpaste wiping trough 31 to be easily cleaned via cleaning brush 50 (FIG. 6). The other end of toothpaste wiping trough 31 has fixedly coupled to wall 34. Wall 34 has an aperture 35 formed therein from which toothpaste enters toothpaste wiping trough 31 via conduit 44 (FIG. 2) of toothbrush neck member 42 (FIG. 2). The back of wall 34 is fixedly coupled to the rim of the bottom portion of sleeve 33. A portion of the back surface area of wall 34 abuts against the surface area of one end of toothbrush neck member 42 (FIG. 2). Moreover, the circumference of neck member 42 (FIG. 2), at the end of toothbrush neck member 42 (FIG. 2), equals the circumference of aperture 35. The distance D between the walls of toothpaste wiping trough 31 does not necessarily equal 2R. More specifically, said distance D should be slightly larger than the width of toothbrush base plate 41, as illustrated in FIG. 1. As further illustrated in FIG. 1, the uppermost edge of toothpaste wiping trough 31 is slightly below toothbrush base plate 41. The distance toothpaste wiping trough 31 is below toothbrush base plate 41 should be, such that the rotation of toothpaste wiping trough 31 around toothbrush base plate 41 and the plurality of bristles 43 is not hindered and the toothpaste are evenly distributed onto the top surface of the plurality of bristles 43, in a single wiping action.

Sleeve 33, is a substantially cylindrical tube-shaped hollow member, is concentric with toothbrush neck member 42 (FIG. 2) whereby sleeve 33 rotates around toothbrush neck member 42 (FIG. 2). Sleeve 33 has fixedly coupled thereto thumb lever 32 wherein sleeve 33 rotates around toothbrush neck member 42 (FIG. 2) when pressure from the user's thumb is applied to thumb lever 32. Accordingly, as sleeve 33 rotates so does toothpaste wiping trough 31 whereby, in a single wiping action, the toothpaste dispensed into toothpaste wiping trough 31 is evenly distributed onto the top surface area of the plurality of bristles 43 (FIG. 1). As the user brushes his or her teeth, a good cleaning effect is obtained because a sufficient amount of the toothpaste is evenly distributed onto the top surface area of the plurality of bristles 43 (FIG. 1).

Referring again to FIG. 1, toothpaste reservoir and dispensing means 20 comprises hollow tubular member 21 having a circumference. The circumference may be of any size that comfortably fits in the hand of the user. However, the larger the circumference the more toothpaste that may be stored in hollow tubular member 21. Said circumference of hollow tubular member 21, from dotted line A, gradually decreases substantially to the circumference of toothbrush neck member 42 (FIG. 2) coupled thereto. Preferably, hollow tubular member 21 is screwably coupled to toothbrush neck member 42 (FIG. 2) in a conventional manner. Hence, when hollow tubular member 21 is unscrewed and detached therefrom, toothbrush neck member 42 (FIG. 2) may be easily cleaned via cleaning brush 50 (FIG. 6), when needed. Nonetheless, hollow tubular member 21 may be fixedly coupled to toothbrush neck member 42 (FIG. 2).

Figure 4:
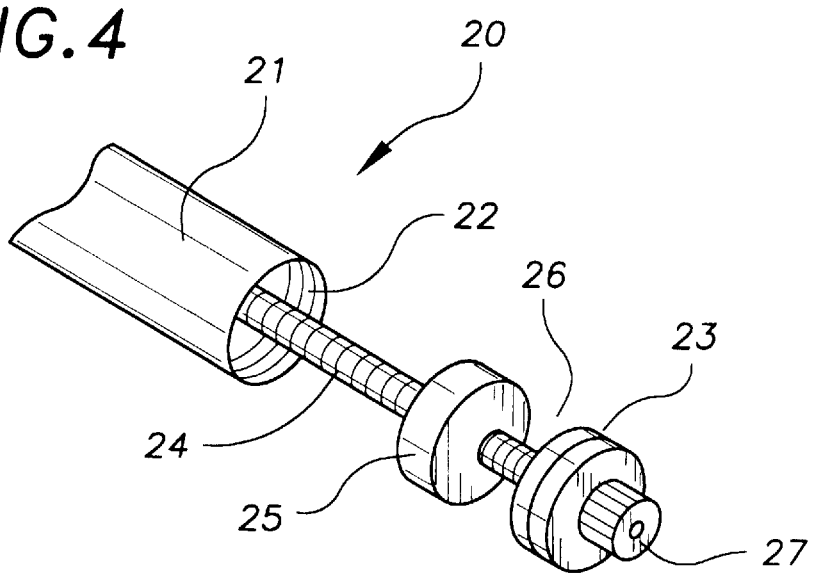
FIG. 4 illustrates an exploded view of the toothpaste reservoir and dispensing means, having dispensing worm screw partially removed therefrom, of the embodiment of FIG. 1.

Referring to FIG. 4, an exploded view of toothpaste reservoir and dispensing means 20 having dispensing worm screw 24, partially removed, is shown. Toothpaste reservoir and dispensing means 20 further comprises threaded means 22, cap member 23, dispensing worm screw 24, plunger 25, threaded cap means 26 and dispensing knob 27. The other distal end of hollow tubular member 21 comprises threaded means 22 integrated into the surface area of hollow tubular member 21. Threaded means 22 matingly couples screwably to cap member 23 via threaded cap means 26 whereby when cap member 23 is unscrewed and removed toothpaste of the users choice enters hollow tubular member 21 via the opening at said other distal end of hollow tubular member 21. Cap member 23 and threaded cap means 26 are unitarily formed theretogether and fixedly coupled to one end of dispensing screw worm 24. Dispensing knob 27 which is disc shaped abuts against the exterior surface area of cap member 23. Plunger 25 which is disc shaped abuts against the interior surface area of threaded cap means 26.

In the exemplary embodiment, the diameter of disc shaped dispensing knob 27 is slightly smaller than the diameter of cap member 23; however, the diameter of dispensing knob 27 may be of any size that easily permits the user to turn dispensing knob 27 to dispense the toothpaste. Furthermore, dispensing knob 27 is not limited to a disc shaped formation. The diameter of disc shaped plunger 25 should be substantially equal to the inner diameter of hollow tubular member 21 so that a tight mating fit exists between plunger 25 and hollow tubular member 21 thereby reducing the amount of residue left along the surface of hollow tubular member 21 as plunger 25 compresses the toothpaste.

Dispensing worm screw 24 has a length that is less than the length of hollow tubular member 21 such that dispensing worm screw 24 ends at dotted line A (FIG. 1) thereby preventing blockages of the toothpaste as the toothpaste enter conduit 44 (FIG. 2) of toothpaste neck member 42 (FIG. 2). Cap member 23, plunger 25, threaded cap means 26 and dispensing knob 27 are concentrically coupled about the axis of dispensing worm screw 24. Accordingly, when dispensing knob 27 is rotated counterclockwise dispensing worm screw 24 rotates. Likewise, plunger 25 rotates counterclockwise and moves in a forward direction along dispensing worm screw 24 thereby applying a force of pressure to the toothpaste stored in hollow tubular member 21. As said force of pressure is applied to the toothpaste, the toothpaste are pushed through toothbrush neck member 42 (FIG. 2) and into toothpaste wiping trough 31 (FIG. 3).

The following description will be referring to the operation of dispensing toothbrush 10 of the present invention. Initially, toothpaste reservoir and dispensing means 20 should be filled with the toothpaste. In doing so, cap member 23 is unscrewed via threaded cap means 26 and removed, as illustrated in FIG. 4. Thereafter, a tube of toothpaste is inserted in the opening at said other distal end of hollow tubular member 21. Dispensing toothbrush 10 should be turned vertically so that the opening of hollow tubular member 21 is in the upward position. As the tube of toothpaste is squeezed, toothpaste enters the hollow tubular member 21 of toothpaste reservoir and dispensing means 20 for storage therein. Cap member 23 is screwed into place via threaded cap means 26 thereby preventing the toothpaste from drying out and maintaining freshness.

Figure 5:
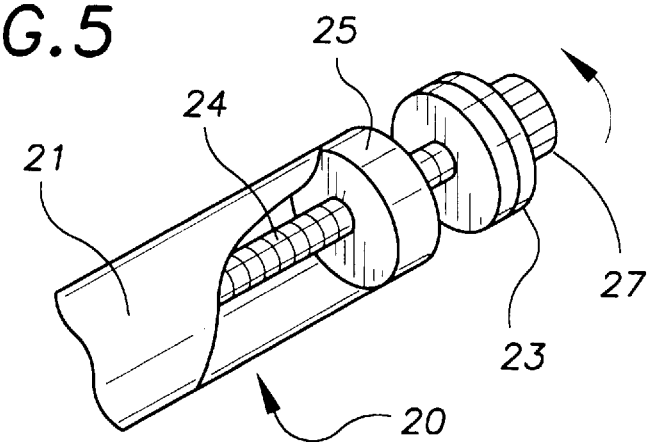
FIG. 5 illustrates a sectional view of the toothpaste reservoir and dispensing means, with the hollow tubular member partially cut-away, of the embodiment of FIG. 1.

When the user desires to brush his or her teeth, dispensing knob 27 is turned counterclockwise thereby moving plunger 25 in a forward direction. FIG. 5 illustrates plunger 25 moving in a forward direction along dispensing worm screw 24. As plunger 25 moves in said forward direction along dispensing worm screw 24, pressure is applied to the toothpaste stored in hollow tubular member 21 and compresses it. Accordingly, the compressed toothpaste, under pressure, moves into conduit 44 of toothbrush neck member 42 and into toothpaste wiping trough 31. A sufficient amount of toothpaste should be dispensed into toothpaste wiping trough 31 to cover the plurality of toothbrush bristles 43.

After dispensing the toothpaste into toothpaste wiping trough 31, the user's thumb applies pressure to thumb lever 32 thereby causing sleeve 33 to rotate accordingly. As sleeve 33 rotates, toothpaste wiping trough 31 evenly distributes the toothpaste onto the top surface area of the plurality of bristles 43, in a single wiping action. The user then proceeds to brush his or her teeth in a conventional manner.

FIG. 6 illustrates an example of cleaning brush 50 useable with the present invention. After the user brushes his or her teeth, toothpaste wiping trough 31 should be cleaned of any residue left on the surface area of toothpaste wiping trough 31, via cleaning brush 50 and dispensing toothbrush 10 should be stored away for future use.

Preferably, after the toothpaste stored in hollow tubular member 21 has been completely used up, hollow tubular member 21 of toothpaste reservoir and dispensing means 20 should be cleaned of any remaining residue of the previous toothpaste which was stored therein via cleaning brush 50 (FIG. 6). Accordingly, hollow tubular member 21 may be refilled thereby extending the useful life of dispensing toothbrush 10 of the present invention.

It can be seen from the preceding description that a dispensing toothbrush for easily dispensing and evenly distributing toothpaste, in a single wiping action, onto the top surface area of a plurality of bristles.

It is noted that the embodiment of the dispensing toothbrush, described herein in detail for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A dispensing toothbrush for use when brushing teeth, said dispensing toothbrush comprising:

brushing means for brushing the teeth comprising:
- a plurality of bristles;
- a toothbrush base plate having said plurality of bristles implanted therein and projected perpendicularly upward therefrom; and
- a toothbrush neck member; and wiping means, concentric with said toothbrush neck member, rotatable to a top surface area of said plurality of bristles, for evenly distributing toothpaste, in a single wiping action, onto the top surface area of said plurality of bristles to obtain a good teeth cleaning effect;

said wiping means including:
- a sleeve concentric about said toothbrush neck member;
- lever means, coupled to said sleeve, for rotating said sleeve when pressure is applied thereto; and toothpaste wiping trough means, coupled to said sleeve, for receiving the toothpaste therein from said toothbrush neck member, wherein, as said pressure is applied to said lever means, said sleeve rotates around said toothbrush neck member, and said toothpaste wiping trough means rotates around said plurality of bristles for evenly distributing the toothpaste onto the top surface area of said plurality of bristles, in said single wiping action.

2. A dispensing toothbrush for use when brushing teeth, said dispensing toothbrush comprising:

brushing means for brushing the teeth comprising:
- a plurality of bristles, and
- toothbrush neck member;

wiping means, concentric with said toothbrush neck member, rotates to a top surface area of said plurality of bristles, for evenly distributing toothpaste, in a single wiping action, onto the top surface area of said plurality of bristles to obtain a good cleaning effect when brushing the teeth; and toothpaste reservoir and dispensing means, coupled to said toothbrush neck member, for storing therein and dispensing therefrom the toothpaste;

said wiping means including a sleeve concentric about said toothbrush neck member;

lever means, coupled to said sleeve, for rotating said sleeve when pressure is applied thereto; and toothpaste wiping trough means, coupled to said sleeve, for receiving the toothpaste therein from said toothbrush neck member, wherein, as said pressure is applied to said lever means, said sleeve rotates around said toothbrush neck member, and said toothpaste wiping trough means rotates around said plurality of bristles for evenly distributing the toothpaste onto the top surface area of said plurality of bristles, in said single wiping action.

3. A dispensing toothbrush for use when cleaning teeth, said dispensing toothbrush comprising:

brushing means for brushing a users teeth, said brushing means comprises:
- a toothbrush base plate,
- a plurality of bristles implanted in and projected perpendicularly upward from said toothbrush base plate, and
- toothbrush neck member coupled to said toothbrush base plate; and wiping means for wiping toothpaste, in a single wiping action, onto a top surface area of said plurality of bristles, said wiping means comprises:
- a sleeve concentric about toothbrush neck member,
- lever means coupled to said sleeve for rotating said sleeve when pressure is applied to said lever means, and toothpaste wiping trough means, coupled to said sleeve, for receiving toothpaste therein from said toothbrush neck member, wherein, as said pressure is applied to said lever means, said sleeve rotates and said toothpaste wiping trough means rotates around said toothbrush base plate and said plurality of bristles for evenly distributing said toothpaste onto the top surface area of said plurality of bristles, in said single wiping action.

* * * * *